United States Patent [19]

Eastman

[11] Patent Number: 4,705,250

[45] Date of Patent: Nov. 10, 1987

[54] SUPPORT STRUCTURE FOR TABLETOPS, CHAIR SEATS AND THE LIKE

[76] Inventor: Jerome K. Eastman, 3 E. Ontario, Chicago, Ill. 60611

[21] Appl. No.: 800,090

[22] Filed: Nov. 20, 1985

Related U.S. Application Data

[63] Continuation of Ser. No. 342,882, Jan. 26, 1982, abandoned.

[51] Int. Cl.[4] ..... F16M 11/32

[52] U.S. Cl. ..... 248/164; 248/174

[58] Field of Search ..... 248/164, 431, 432, 165, 248/188.1, 188.6, 174; 108/118, 119; 217/12 R, 43 R, 48, 49

[56] References Cited

U.S. PATENT DOCUMENTS

| | | | |
|---|---|---|---|
| 592,944 | 11/1897 | Wilson | 217/48 |
| 806,058 | 11/1905 | Brown | 248/174 UX |
| 1,285,580 | 11/1918 | Bachtel | 248/432 X |
| 1,687,616 | 10/1928 | Huye | 248/174 |
| 2,613,834 | 10/1952 | Gillet et al. | 217/43 |
| 2,639,114 | 5/1953 | Allen | 248/174 X |
| 2,707,048 | 4/1955 | Schultz | 217/48 X |
| 3,071,277 | 1/1963 | Olson et al. | 217/12 R |
| 3,074,771 | 1/1963 | Wilson | 248/164 |
| 3,079,025 | 2/1963 | Herman | 217/12 R |
| 3,533,586 | 10/1970 | Chichester | 248/188.1 |
| 3,718,261 | 2/1973 | Woofter | 248/174 X |

FOREIGN PATENT DOCUMENTS

| | | | |
|---|---|---|---|
| 1282708 | 12/1961 | France | 248/174 |
| 593520 | 3/1959 | Italy | 248/431 |

*Primary Examiner*—J. Franklin Foss

*Attorney, Agent, or Firm*—Neuman, Williams, Anderson & Olson

[57] ABSTRACT

A support structure comprising a plurality of rigid members and connectors which when assembled provide an inexpensive, attractive support structure for table tops, chair seats, and the like.

11 Claims, 55 Drawing Figures

527
524AX
517
531
535
534
521
523
519
524AX 527
517
524AX
521
525
529
533
532

524ML
527
E1
535
531
519
524AX
529
533
524ML
E1
525
521

SUPPORT STRUCTURE FOR TABLETOPS, CHAIR SEATS AND THE LIKE

This application is a continuation of application Ser. No. 342,882 filed Jan. 26, 1982 now abandoned.

This invention relates to a support structure for table tops, chair seats, and the like. More particularly, it relates to a suppport structure which can be offered in a wide variety of styles, which can be inexpensively and attractively fashioned from few components, which can be readily assembled and disassembled without the use of special skills or tools, and which provides a tight and durable, yet geometrically appealing, means for supporting table tops, chair seats, and similar items.

BACKGROUND OF THE INVENTION

Custom-made furniture offers several advantages to those who can afford it. First, unique and interesting designs may be developed by the purchaser or a professional designer to fill a particular need. Second, skilled artisans can select from a wide variety and quality of materials to implement any design. Finally, the quality of workmanship may be specified by the purchaser or he may simply trust in the painstaking care of a master craftsman who uses his special skills and tools to create a fine piece of furniture.

Custom-made table bases enjoy all of these advantages. Noted designers and architects design table bases very different from the four-vertical-legged support structures typical of most tables. Their designs utilize novel and varied geometries, and the materials selected to implement their designs bear little resemblence to the standard turned wood used on many table bases. The craftsmen who custom-make table bases are skilled in the art of furniture making and have at their disposal all of the sophisticated machinery necessary to piece together the various components of a design. Consequently, a finished custom-made table base is tight and durable, as well as unique and attractive.

SUMMARY OF THE INVENTION

The invention evolved under the general object of providing a tight and durable, yet varied and geometrically appealing, support structure for table bases, chair seats and similar items. As has been indicated, such support structures are available from custom designers and builders. However, custom-made tables and chairs are frequently prohibitively expensive. Much of this expense results from (1) the time and effort expended by the designer to determine and meet the purchaser's specific needs and (2) the sophisticated machinery and special skills utilized by the builder to fabricate a tight, durable, and attractive piece.

Accordingly, the invention provides a unique combination of members and connecting means which can be quickly and easily assembled in one of several geometric configurations whereby a table top or the like is supported above a supporting surface. For each configuration, the lower ends of the rigid members define a polygon, and the plane defined by one side of the polygon and the axis of a member defining that side intersects the plane of the polygon at a particular support angle, the support angle being an acutre angle.

The invention also features a tight joining of the members and durable configuration. Each rigid member supports two adjacent members in addition to a portion of the table top, i.e., each rigid member is attached by one connecting means to a second rigid member at one interface and by another identical connecting means to a third rigid member at another interface. In addition, each connecting means includes an elongate metal piece which acts as a pin to prevent relative motion between the members lateral to the pin. Since none of the connecting means require tools more sophisticated than a simple wrench nor skills more special than an elementary knowledge of nuts, bolts, and pins, the invention provides a tight, durable support structure which can be fabricated without the use of sophisticated machinery or special skills.

Another feature of the invention relates to the variety of geometries it provides. Both the support angle for each rigid member and the number of members comprising the support structure may be predetermined according to a desired appearance. This wide variety of geometries allows perspective purchasers, who are already aware of their own specific needs, to select the exact configuration that meets those needs.

Other objects, features and advantages of this invention will become apparent upon reading the appended claims and examining the following drawings and detailed description of certain embodiments of the invention.

DESCRIPTION OF THE PREFERRED EMBODIMENTS

The drawings disclose two preferred embodiments of the table base of the invention. An example of the first preferred embodiment is shown in assembled form in FIG. 1. It comprises three identical rigid members 101, 103, 105 which support a glass table top 107 above a supporting surface 109 and three identical connectors 111, 113, 115 which fixedly maintain the members 101, 103, 105 in a tepee-like configuration. While this and other examples of the preferred embodiments of the invention are shown in assembled form, it is contemplated that the support structure of the invention will be sold and shipped in disassembled form with all members and connectors prefabricated and awaiting assembly by the purchaser.

Figure 2:
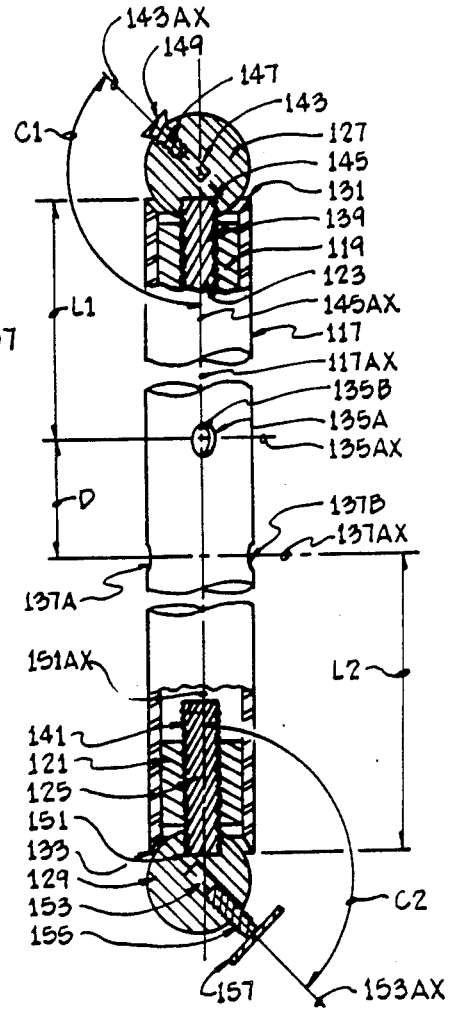
FIG. 2 is a fragmentary elevation view of one of the rigid cylindrical members of the table base of FIG. 1.
Figure 3:
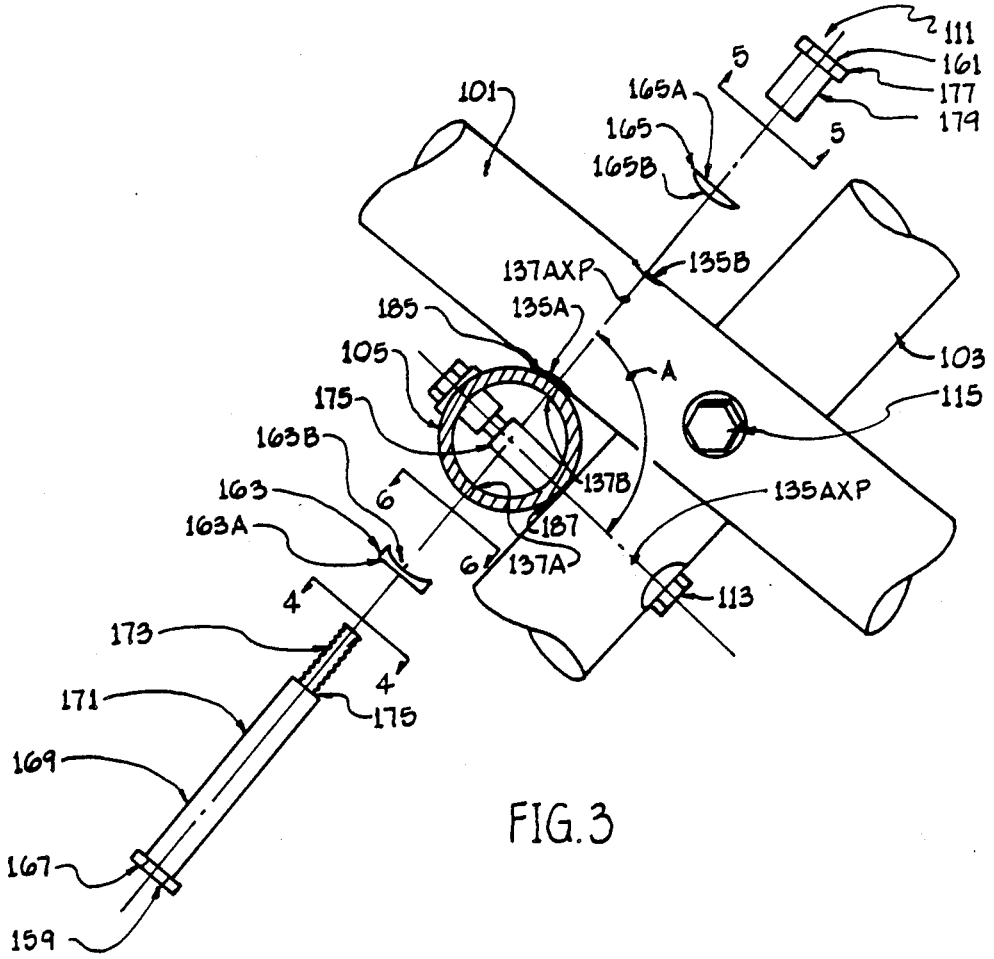
FIG. 3 is an isolated view of the interconnection of the rigid cylindrical members and an exploded connector of the table base of FIG. 1 looking along the axis of a member from a section line as indicated by line 3—3 in FIG. 1.

As shown in FIG. 2, each member comprises an elongate cylindrical metal tube 117 and upper and lower cylindrical metal plugs 119, 121, running threads 123, 125, and metal spheres 127, 129. The elongate cylindrical metal tube 117 has upper and lower beveled ends 131, 133, an upper set of facing holes 135A, 135B lying along an upper axis 135AX, a lower set of facing holes 137A, 137B lying along a lower axis 137AX, and a longitudinal axis 117AX which is colinear with the axis 117AX of the member 101, 103, 105. The upper axis 135AX and the lower axis 137AX perpendicularly intersect the longitudinal axis 117AX of the tube 117 at points separated by an intersect distance D and equidistant from the midpoint of the tube 117. The length ratio, i.e., the ratio of the length of the upper portion L1 of the tube 17 (from the upper axis 135AX to the upper end 131) to the length of the lower portion L2 (from the lower axis 137AX to the lower end 133), equals one. The projections 135AXP, 137AXP of the axes 135AX, 137AX onto a plane perpendicular to the longitudinal axis 117AX intersect at a projection angle A, as shown in FIG. 3.

The spacial relationship of the upper axis 135AX to the lower axis 137AX depends on the geometry of the configuration. For the three-member table base shown in FIG. 1, the lower ends of each member 101, 103, 105 define an imaginary polygon of three sides 138A, 138B, 138C. A first side 138C of the polygon and the axis 117AX of a first member 105 defining that side 138C further define a plane that intersects the plane of the polygon at a support angle B1, the plane of the polygon being generally parallel to the supporting surface 109 and the plane of the table top 107. Analogous planes defined by the remaining members 101, 103 and polygon sides 138A, 138B, respectively, intersect the plane of the polygon at the same support angle B1, which is an acute angle for all ccnfigurations of the table base of the invention. Both the intersect distance D and the projection angle A depend on the support angle B1; for as it decreases, they increase.

During the setup phase of prefabrication, the intersect distance D and the projection angle A may be determined empirically by holding the members 101, 103, 105 in the desired configuration, i.e., with each member 101, 103, 105 defining the desired support angle B1, and marking the outside surface of each member 101, 103, 105 at the points where it contacts the outside surfaces of the two adjacent members 101, 103, 105. Each tube 117 is then drilled perpendicularly through its longitudinal axis 117AX at the two markings to produce the two sets of facing holes 135A, 135B, 137A, 137B at the proper intersect distance D and projection angle A. These quantities may then be measured and entered into a programmable jig which will thereafter drill the two sets of facing holes 135A, 135B, 137A, 137B automatically during the production phase of prefabrication.

As shown in FIG. 2, the upper and lower cylindrical metal plugs 119, 121 are identical. Each has a diameter which closely corresponds to the inside diameter of the tube 117 so the plug 119, 121 can be inserted inside the tube 117 with a minimum tolerance between them. During prefabrication, the plugs 119, 121 are disposed inside the tube 117 a short distance from the beveled ends 131, 133 and are welded in place. An axial hole 139, 141 runs the length of each plug 119, 121 and is tapped to correspond with the running threads 123, 125, both running threads 123, 125 being identical.

The upper sphere 127 has two radial holes 143, 145 that only partially penetrate. The axes 143AX, 145AX of these holes 143, 145 are oriented with respect to each other such that when one axis 145AX is aligned with the longitudinal axis 117AX of a member 101, 103, 105 in the assembled configuration of FIG. 1 with the hole 145 opening toward the member 101, 103, 105, the other axis 143AX will be vertical with the hole 143 opening upward and at a first translation angle C1 to the aligned axis 145AX.

The vertical hole 143 in the upper sphere 127 houses the shank 147 of an elastomeric pad 149 that supports the glass table top 107 above the upper sphere 127 and securely holds it in place. The diameters of the hole 143 and the shank 147 are designed to ensure a tight fit between them, the shank 147 being inserted into the hole 143 during prefabrication.

In another example of the first embodiment of the invention (not shown), with a wooden, rather than a glass, table top 107, the vertical hole 143 totally penetrates the upper sphere 127. During assembly, a wood screw may then be inserted through the hole 143 and screwed into the table top 107 to securely hold it in place.

As shown in FIG. 2, the other hole 145 in the upper sphere 127 has the same diameter and is tapped with the same thread as the hole 139 in the upper plug 119, and it is deep enough to provide a secure anchor for the upper running thread 123. The upper sphere 127 is attached to the tube 117 during prefabrication by threading one end of the upper running thread 123 to the bottom of the tapped hole 145 in the upper sphere 127 and threading the other end into the tapped hole 139 in the upper plug 119.

The lower sphere 129 also has two radial holes 151, 153 that only partially penetrate. The axes 151AX, 153AX of these holes 151, 153 are oriented with respect to each other such that when one axis 151AX is aligned with the axis 117AX of a member 101, 103, 105 in the assembled configuration of FIG. 1 with the hole 151 opening toward the member 101, 103, 105, the other axis 153AX will be vertical with the hole 153 opening downward and at a second translation angle C2 to the aligned axis 151AX. Both the first and second translation angles C1, C2 are directly proportional to the support angle B1.

As shown in FIG. 2, the hole 151 in the lower sphere 129 aligned with the longitudinal axis of the member 101, 103, 105 has the same diameter and is tapped with the same thread as the hole 141 in the lower plug 21, and it is deep enough to provide a secure anchor for the lower running thread 125. The lower sphere 129 is attached to the tube 117 during prefabrication by threading one end of the lower running thread 125 to the bottom of the tapped hole 151 in the lower sphere 129 and threading the other end into the tapped hole 141 in the lower plug 121.

The other hole 153 in the lower sphere 129 is tapped to correspond with the threads on the shank 155 of a foot 157, which is attached to the lower sphere 129 by threading the shank 155 into the hole 153. The distance from the lower sphere 129 to the bottom of the foot 157 can be adjusted by screwing the threaded shank 155 into or out of the tapped hole 153, which is deep enough to allow a sufficient range of adjustment.

Figure 4:
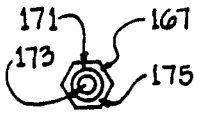
FIG. 4 is a bottom plan view of the bolt of a connector of the table base of FIG. 1 looking from a section line as inqicated by line 4—4 in FIG. 1.

The other principal components of the table base are the connectors 111, 113, 115. As shown in FIG. 3, each connectgr comprises a hex-head shoulder bolt 159, a corresponding hex-head nut 161, and first and second saddle washers 163, 165. The bolt 159 has a hex head 167 and a shank 169 with an unthreaded portion 171 and a threaded portion 173. The length of the shank 169 is approximately twice the outside diameter of the tube 117. The length of the unthreaded portion 171 is approximately one and one half of the outside diameter of the tube 117. The diameter of the unthreaded portion 171 closely corresponds to the diameters of the facing holes 135A, 135B, 137A, 137B of the tube 117 so the shank 169 can be inserted through the facing holes 135A 135B, 137A, 137B with a minimum tolerance between the unthreaded portion 171 and the tube 117. The diameter of the threaded portion 173 is smaller than the diameter of the unthreaded portion 171, and the abrupt change in diameters produces a shoulder 175 on the bolt 159. FIG. 4 presents a plan view of the bolt 159.

Figure 5:
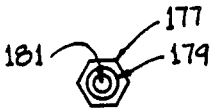
FIG. 5 is a bottom plan view of the nut of a connector of the table base of FIG. 1 looking from a section line as indicated by line 5—5 in FIG. 1.

As shown in FIG. 3, the nut 161 has a hex head 177 and a shank 179. The hex head 177 on the nut 161 is the same size as the hex head 167 on the bolt 159, and the diameter of the shank 179 equals the diameter of the unthreaded portion 171 of the shank 169 of the bolt 159. FIG. 5 shows a plan view of the nut 161. An axial hole 181 in the shank 179 runs the entire length of the nut 161 and is tapped to correspond with the threaded portion 173 of the bolt 159.

Figure 6:
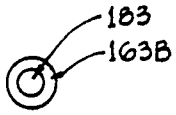
FIG. 6 is a plan view of the concave side of a washer of the connector of the table base of FIG. 1 looking from a section line as indicated by line 6—6 in FIG. 1.

The saddle washers 163, 165 are identical. As shown in FIG. 3, each has a flat side 163A, 165A and a concave side 163B, 165B with the degree of concavity corresponding to the outer diameter of the tube 117. FIG. 6 presents a top plan view of the concave side 165B of the second saddle washer 165. The diameter of the concentric hole 183 in the washers 163, 165 closely corresponds with the diameter of the unthreaded portion 171 of the shank 169 of the bolt 159 and the shank 179 of the nut 161 so the washer 165 can slip over the shank 169, 179 of the bolt 159 or nut 161 with a minimum tolerance between the bolt 159 or nut 161 and the washer 165.

Figure 1:
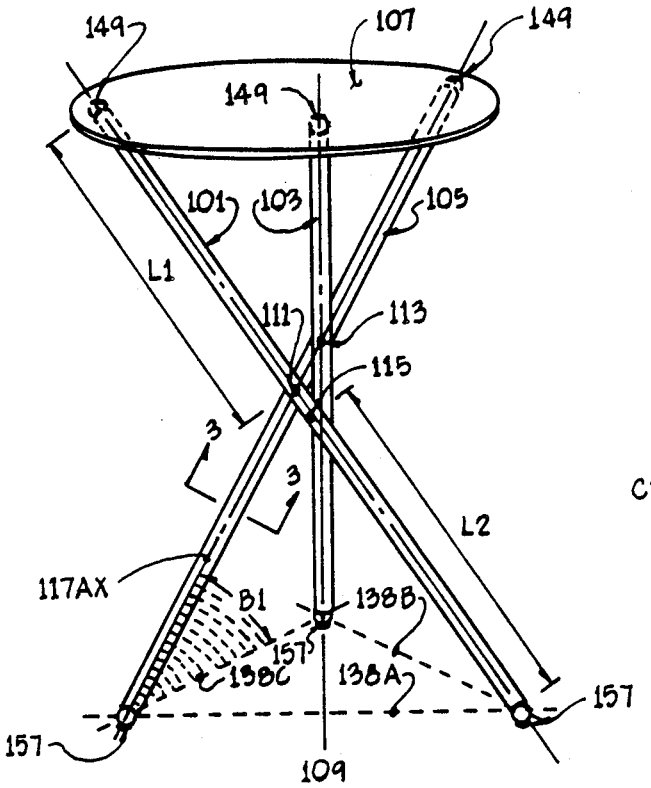
FIG. 1 is a perspective view of one example of the first preferred embodiment of the invention illustrating a table base which includes three identical rigid cylindrical members interconnected in a tepee-like configuration by three identical connectors.

The prefabricated components then include only the three rigid members 101, 103, 105, with pads 149 and feet 157 attached, and the three connectors 111, 113, 115 shown in FIG. 1. Such few components facilitate packing and shipping. All of these components can be compactly packed and shipped in one thin, flat box. A wider and only slightly less flat box could even include the table top 107. Such few components also facilitate assembly.

As shown in FIG. 3, the members 101, 103, 105 are assembled in their tepee-like configuration by first inserting the shank 169 of the shoulder bolt 159 of a first connector 111 through the hole 183 in the first saddle washer 163 so the flat side 163A of the washer 163 contacts the head 167 of the bolt 159. The shank 169 of the bolt 159 is then inserted through the lower set of facing holes 137A, 137B in a first member 105 with the concave side 163B of the washer 163 flush against the outside surface of the member 105. Since the shank 169 of the bolt 159 is longer than the outside diameter of the member 105, a portion of the shank 169 will protrude beyond the outside surface of the member 105. This portion of the shank 169 is inserted through a first hole 135A in the upper set of facing holes 135A, 135B in a first adjacent member 101, so the outside surface of the first adjacent member 101 contacts the outside surface of the member 105 at a first interface 185. The minimum tolerance between the unthreaded portion 171 of the shank 169 of the bolt 159 and the holes 135A, 137B allows the inserted bolt 159 to act as a pin to prevent relative lateral motion between adjacent members 101, 105. The shank 179 of the nut 161 is then inserted first through the hole 183 in the second saddle washer 165 so the flat side 165A of the washer 165 contacts the head 177 of the nut 161 and then through the other upper hole 135B in the adjacent member 101 so the threads of the tapped hole 181 in the nut 161 contact the threads of the threaded portion 173 of the shank 169 of the bolt 159. The nut 161 is then partially tightened onto the bolt 159 with the concave side 165A of the second saddle washer 165 flush against the outside surface 134 of the adjacent member 101.

This procedure is then repeated with connector 113, inserting it through the lower set of holes in a second adjacent member 103 and the upper set of holes in the first member 105 so the outside surface of member 105 contacts the outside surface of the second adjacent member 103 at a second interface 187, and with connector 115, inserting it through the lower set of holes in member 101 and the upper set of holes in member 103 so the outside surface of member 103 contacts the outside surface of member 101 at a third interface (not visible). Since the bolts 159 in each member 101, 103, 105 are then aligned with the axes 135AX, 137AX of the facing holes 135A, 135B, 137A, 137B in the member 101, 103, 105, the axes of the bolts 159 enjoy the same spacial relationship as the axes 135AX, 137AX of the holes 135A, 135B, 137A, 137B. Further, since the axes of the bolts 159 in each member 101, 103, 105 are perpendicular to the axis 117AX of the member 101, 103, 105 and since the axis 117AX of the member 101, 103, 105 intersects the plane of the polygon and the generally parallel plane of the table top 107 at an acute angle, the axes of the bolts 159 also intersect the planes of the polygon and table top at an acute angle.

After all of the connectors 111, 113, 115 are in place, the nuts 161 of the connectors 111, 113, 115 are sufficiently tightened onto the corresponding bolts 159 to fixedly secure and maintain the members 101, 103, 105 in the tepee-like configuration shown in FIG. 1. As shown by connector 113 in FIG. 3, the unthreaded portion 171 of the shank 169 of the bolt 159 and the shank 179 of the nut 161 are designed to be short enough to prevent the shoulder 175 of the bolt 159 from contacting the shank end of the nut 161 once the nut 161 has been tightened onto the bolt 159. This design (1) allows the nut 161 to be sufficiently tightened onto the bolt 159 initially and (2) allows the nut 161 to be further tightened onto the bolt 159 subsequently if the joint between the two members 103, 105 loosens due, for example, to thermal stress or wear at the interface between the adjacent members 103, 105. The threaded portion 173 of the bolt 159 is designed to be long enough to attain a secure anchor in the nut 161, but not so long as to extend beyond the head 177 of the nut 161.

After the members 101, 103, 105 have been interconnected by the connectors 111, 113, 115, the feet 157 of the members 101, 103, 105 are placed on the supporting surface 109, and the table top 107 is placed on the elastomeric pads 149. The table top 107 may then be leveled by adjusting the feet 157.

The first preferred embodiment of the invention is thus readily assembled into a tight, sturdy configuration with no more than a pair of simple wrenches and an elementary knowledge of nuts and bolts. The close fit of the unthreaded portion 171 of the shank 169 of each bolt 159 in the holes 135A, 137B at each interface prevents relative motion of adjacent members perpendicular to the axis of the bolt 159. The cooperation between the nut 161 and the bolt 159 prevents relative motion of adjacent members along the bolt 159. Finally, since each member is tilted according to its support angle B1, it supports its two adjacent members as well as the table top 107.

The three-member table base shown perspectively in FIG. 1 (and shown orthographically in FIGS. 7 and 8) is but one example of the first preferred embodiment of the invention. Other examples, including those shown in FIGS. 8–24, may differ with respect to one or, more of the following characteristics: (1) the length ratio, (2) the support angle or (3) the number of members. However while the geometries of different examples may differ, the methods of assembly are all identical, i.e., each rigid member is connected to one adjacent member by one connector at one interface and to a second adjacent member by a second identical connector at a second interface.

Figure 7:
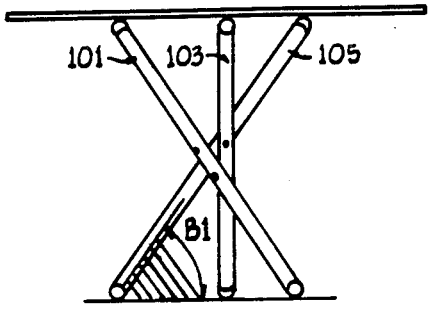
FIG. 7 is an orthographic elevation view of the table base of FIG. 1.
Figure 9:
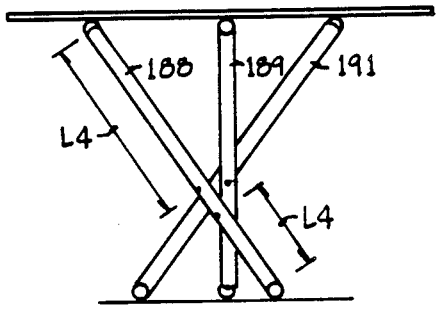
FIG. 9 is an elevation view of another example of the first preferred embodiment of the invention illustrating a table base with a length ratio greater than that of the table base of FIG. 1.
Figure 10:
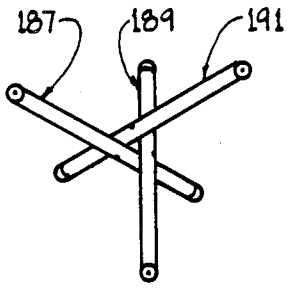
FIG. 10 is a top plan view of the table base of FIG. 9.

FIG. 9 presents a three-member table base similar in all respects to the table base of FIG. 7, except that its length ratio is greater than that of the table base shown in FIG. 7. A length ratio greater than one affords more comfortable sitting at the table. Since the lower portion L3 is shorter than the upper portion L4, the area defined by the lower ends of the members 188, 189, 191 is smaller than the area defined by the upper ends. Consequently, there is more foot room at the table base shown in FIG. 9 than at the table base shown in FIG. 7.

Figure 11:
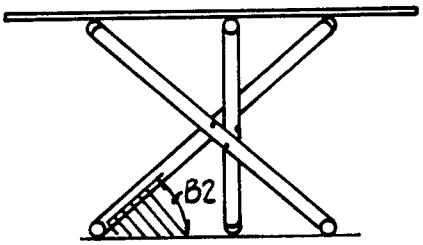
FIG. 11 is an elevation view of another example of the first preferred embodiment of the invention illustrating a table base with a support angle smaller than that of the table base of FIG. 1.
Figure 12:
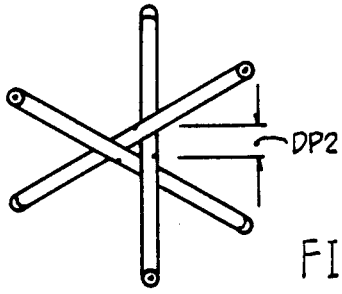
FIG. 12 is a top plan view of the table base of FIG. 11.
Figure 13:
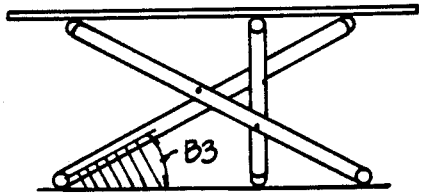
FIG. 13 is an elevation view of another example of the first preferred embodiment of the invention illustrating a table base with support angle smaller than that the table base of FIG. 11.
Figure 14:
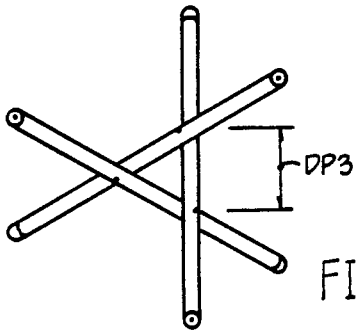
FIG. 14 is a top plan view of the table base of FIG. 13.
Figure 15:
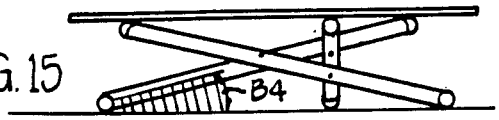
FIG. 15 is an elevation view of another example of the first preferred embodiment of the invention illustrating a table base with a support angle smaller than that of the table base of FIG. 13.
Figure 16:
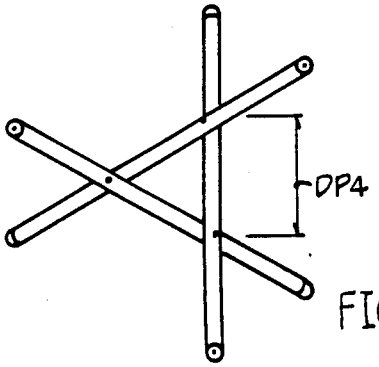
FIG. 16 is a top plan view of the table base of FIG. 15.
Figure 18:
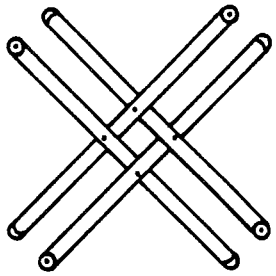
FIG. 18 is a top plan view of the table base of FIG. 17.
Figure 17:
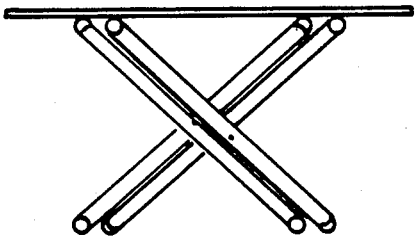
FIG. 17 is an elevation view of another example of the first preferred embodiment of the invention illustrating a table base which includes four identical rigid cylindrical members and four identical connectors.
Figure 20:
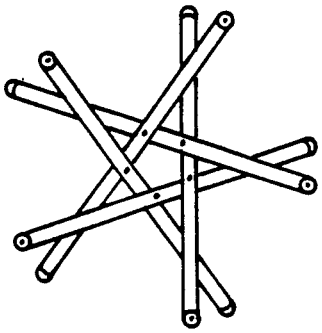
FIG. 20 is a top plan view of the table base of FIG. 19.
Figure 19:
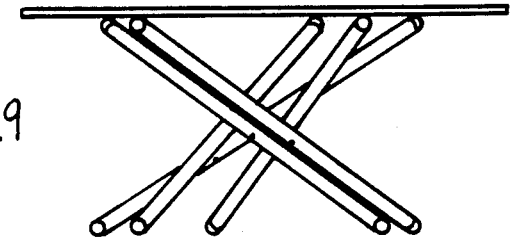
FIG. 19 is an elevation view of another example of the first preferred embodiment of the invention illustrating a table base which includes five identical rigid cylindrical members and five identical connectors.
Figure 22:
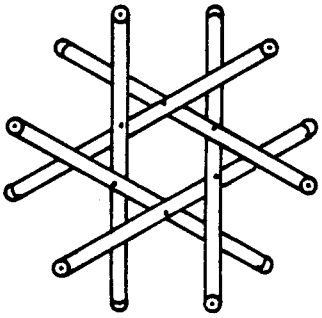
FIG. 22 is a top plan view of the table base of FIG. 21.
Figure 21:
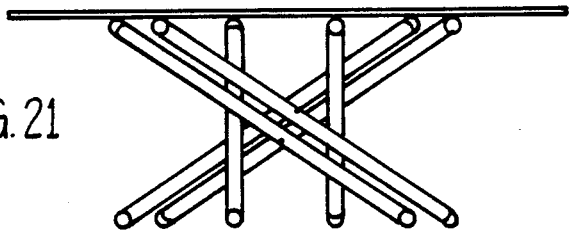
FIG. 21 is an elevation view of another example of the first preferred embodiment of the invention illustrating a table base which includes six identical rigid cylindrical members and six identical connectors.
Figure 24:
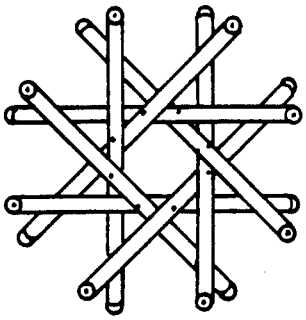
FIG. 24 is a top plan view of the table base of FIG. 23.
Figure 23:
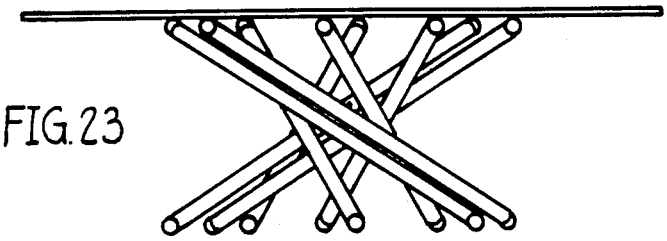
FIG. 23 is an elevation view of another example of the first preferred embodiment of the invention illustrating a table base which includes eight identical rigid cylindrical members and eight identical connectors.

FIG. 11 presents an example of the first preferred embodiment of the invention which is also very similar to the table base of FIG. 7, except that its support angle B2 is smaller than that of the table base shown in FIG. 7. In fact, FIG. 7, FIG. 11, FIG. 13 and FIG. 15 present a series of similar table bases, each differing from the one before it only by a smaller support angle B1, B2, B3, B4. The principal consequences of this decrease in the support angle are an increase in the intersect distance (The intersect distance, through its projections DP1, DP2, DP3, DP4 on a horizontal plane, can be seen increasing in FIGS. 8, 2, 14 and 16 respectively.) and the projection angle and a decrease in the translation angle for each member. Thus, an entire family of tables, from a dining table (FIGS. 7 and 8) through a cocktail table (FIGS. 11 and 12) and end table (FIGS. 13 and 14) down to a coffee table (FIGS. 15 and 16), can be manufactured by making only slight changes in the specifications for each member. While the height of these tables varied because the support angle varied, these heights could also have been effected by merely varying the length of the members.

Although all of the members of each of the examples depicted in FIGS. 7–16 define equal support angles, these angles are independent of one another, and each may be specified separately according to a desired appearance of the table base. Thus, for yet another example (not shown) of the first preferred embodiment of the invention, each of the members defines a different support angle. However, since the support angles are not equal, the members are not identical. Each member has a characteristic length, intersect distance, projection angle, and translation angle that depends on the support angle specified.

FIGS. 17–24 present still further examples of the first preferred embodiment of the invention. Each example comprises a given number of rigid members which support a glass table top above a supporting surface and an equal number of connectors which fixedly maintain the members in a tepee-like configuration. Thus, FIGS. 17 and 18, 19 and 20, 21 and 22, and 23 and 24 respectively show table bases having four members and four connectors, five members and five connectors, six members and six connectors, and eight members and eight connectors. For all embodiments of the invention, the number of members equals the number of connectors. Other examples having a different number of members cguld have been shown, but, for purposes of illustration, those presented are sufficient.

Figure 8:
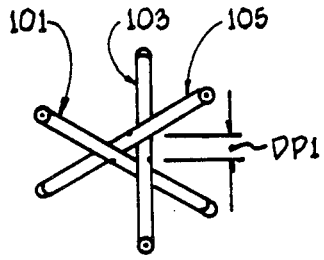
FIG. 8 is a top plan view of the table base of FIG. 7.

The only principal difference between the table bases shown in FIGS. 17–24 and the table base discussed in connection with FIGS. 1, 7 and 8 is the number of members and connectors comprising the table base. For any one of these table bases, all of the members are identical, each member including the elongate cylindrical metal tube and the upper and lower cylindrical metal plugs, running threads, and metal spheres as previously described and shown in FIG. 2. Further, all of the connectors are identical, each connector including the bolt, nut, and first and second saddle washers described above and shown in FIG. 3. And finally, the method of assembling these table bases is identical, each member being connected to a first adjacent member at a first interface by one connector and to a second adjacent member at a second interface by another connector, again, as previously described.

The differing number of members does, however, give rise to certain secondary differences. The intersect distance and the projection angle depend on the number of members comprising the table base as well as on the support angle. Thus, for a given support angle, the intersect distances and projection angles for the four-, five-, six-, and eight-member table bases are all different from that of the three-member table base and each different from one another. However, for any example of the first preferred embodiment of the invention which has the number of members and the support angles specified, the intersect distance and the projection angle can be determined empirically during the setup phase of prefabrication by the previously described method, i.e., by holding the members in the desired configuration, marking each member at the points it contacts the two adjacent members, and drilling perpendicularly through the axis of each member at the two markings. The intersect distance and the projection angle can then be measured, and the jig can be reprogrammed with these values during the production phase of prefabrication.

The drawings also disclose a second preferred embodiment of the table base of the invention. An example of this embodiment is shown in assembled form in FIGS. 25 and 26. It comprises three identical rigid members 501, 503, 505 which support a glass table to 507 above a supporting surface 509 and three identical metal connectors 511, 513, 515 which fixedly maintain the members 501, 503, 505 as an inverted truncated pyramid.

Figure 25:
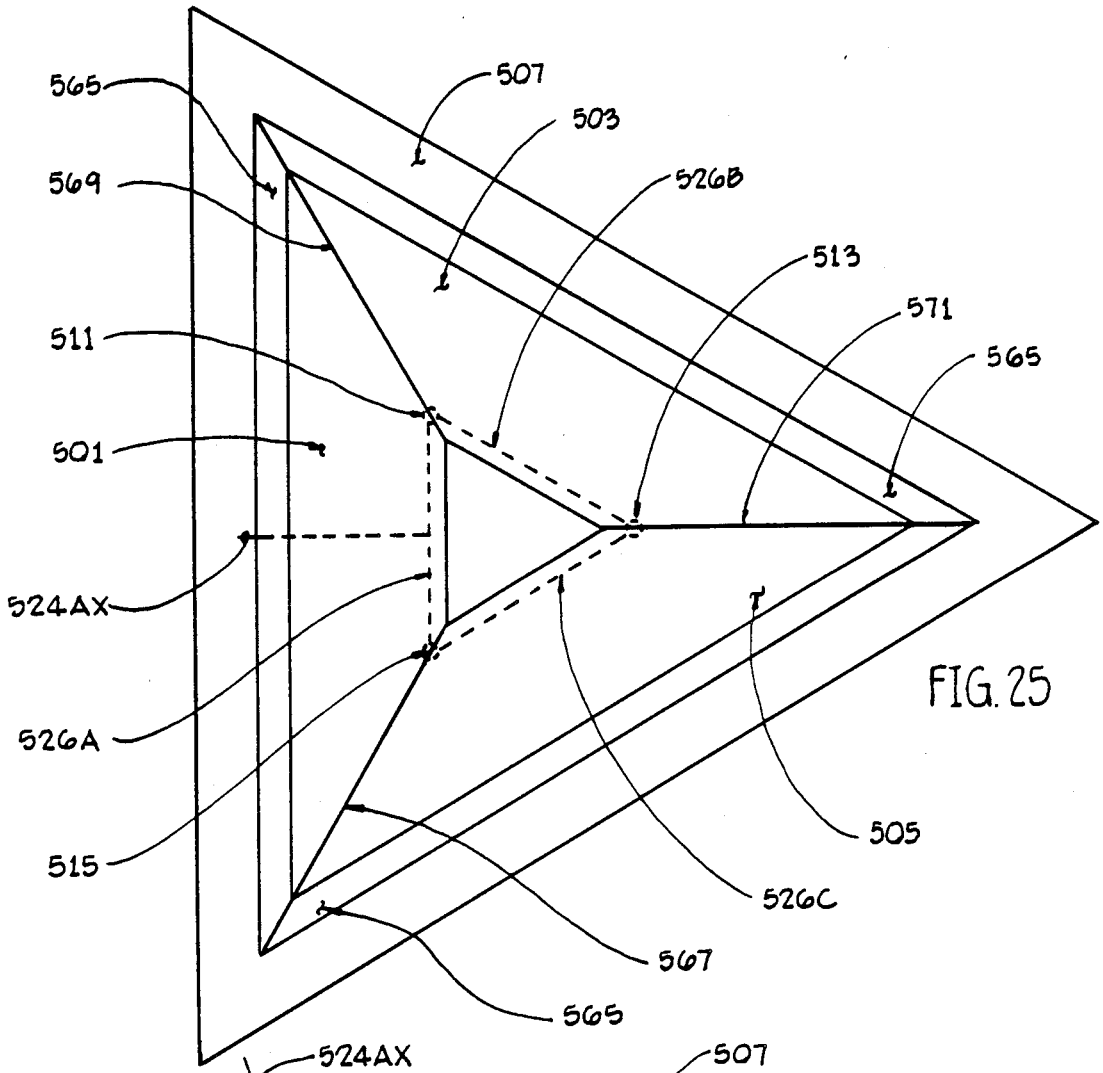
FIG. 25 is a top plan view of one example of the second preferred embodiment of the invention illustrating a table base which includes three identical rigid members interconnected as an inverted truncated pyramid by three identical, connectors.
Figure 26:
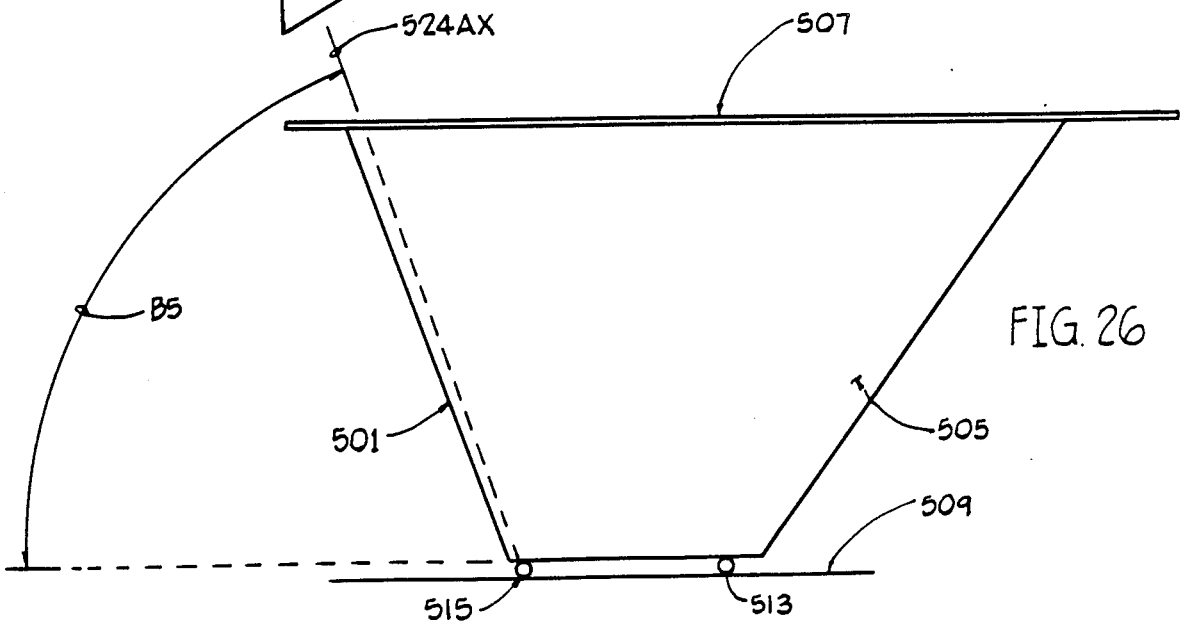
FIG. 26 is an elevation view of the table base of FIG. 26.
Figures 27, 28, 29:
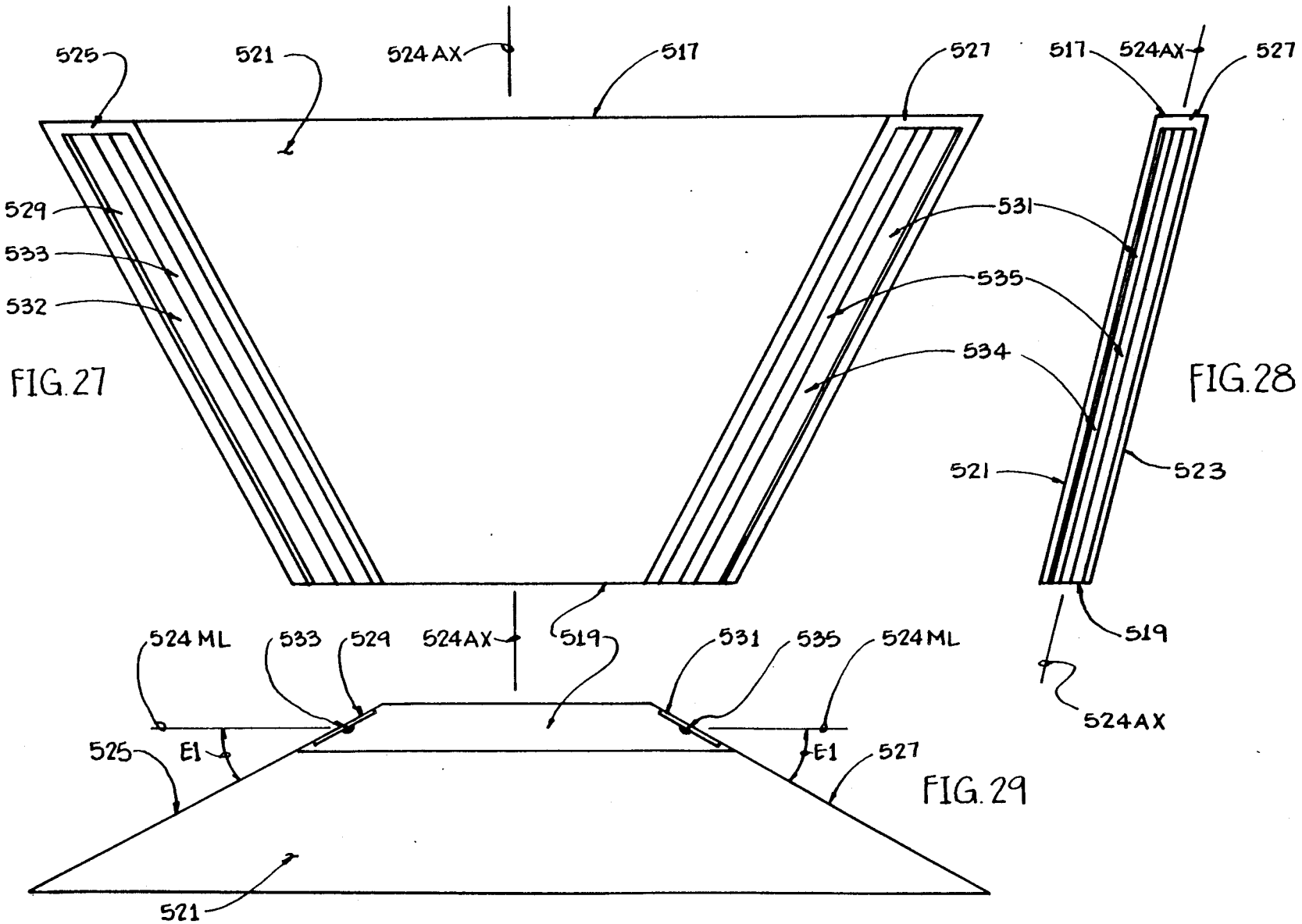
FIG. 27 is an elevation view of one of the rigid members of the table base of FIG. 26.
FIG. 28 is a side view of the rigid member of FIG. 27.
FIG. 29 is a bottom plan view of the rigid member of FIG. 27.
Figures 30, 31, 32, 33:
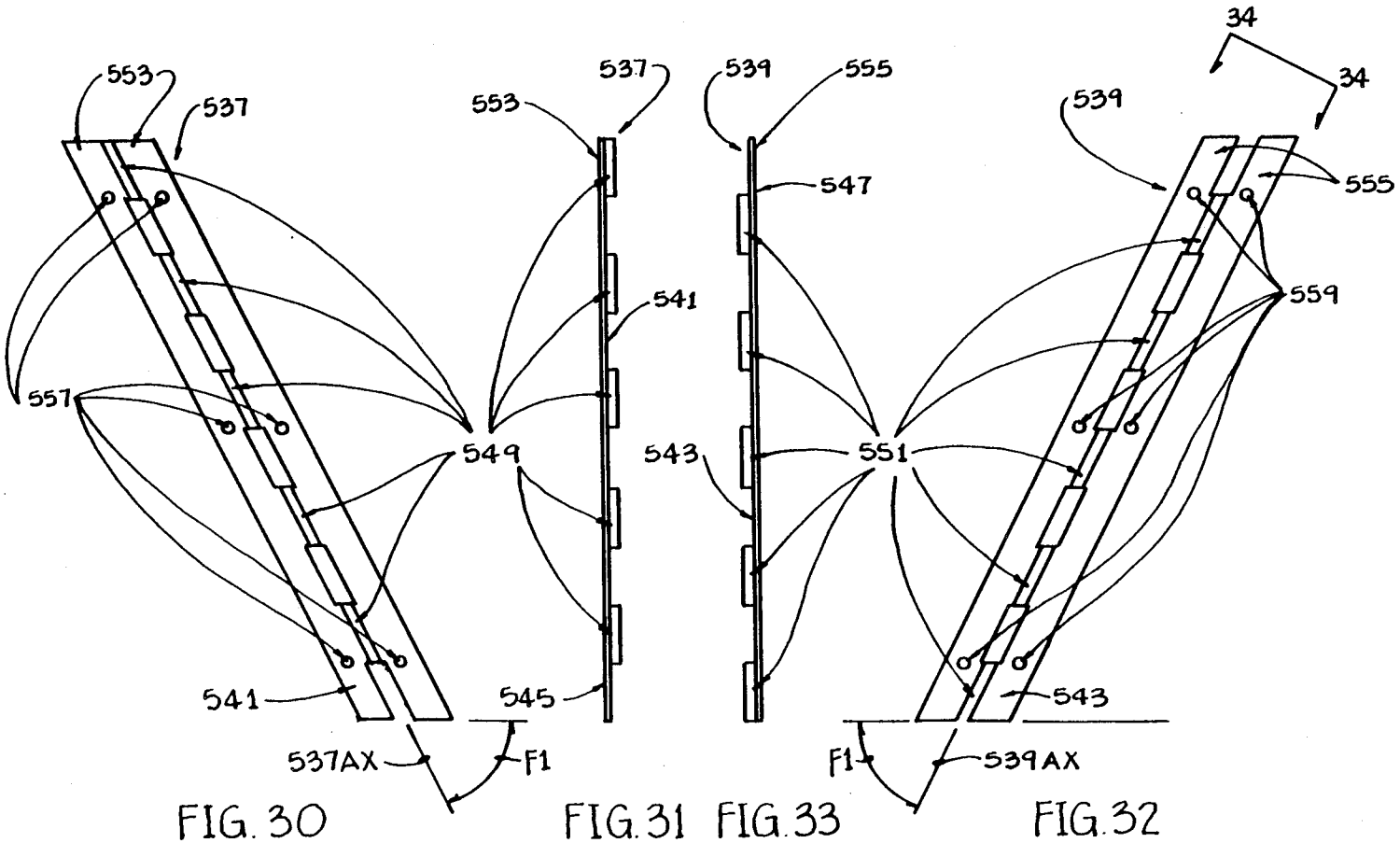
FIG. 30 is an elevation view of a first opposing leaf of a connector of the table base of FIG. 25.
FIG. 31 is a side view of the first opposing leaf of FIG. 30.
FIG. 32 is an elevation view of a second opposing leaf of a connector of the table base of FIG. 25.
FIG. 33 is a side view of the second opposing leaf of FIG. 32.

Each member 501, 503, 505 comprises a standard wood frame, cardboard honeycomb core, and plywood shell construction and, as shown in FIGS. 27, 28 and 29, has upper and lower ends 517, 519 and inside and outside surfaces 521, 523 which form, in cross section, a parallelogram. The axis 524AX of each member 501, 503, 505 is parallel to the inside and outside surfaces 521, 523 and intersects the longitudinal midline 524ML of the lower end 519. As shown in FIGS. 25 and 26, the lower ends of the assembled members 501, 503, 505 define an imaginary polygon with the longitudinal midlines of the lower ends forming the polygon's three sides 526A, 526B, 526C. A first side 526A and the axis 524AX of a first member 501 defining that side 526A further define a plane that intersects the plane of the polygon at a support angle B5, the plane of the polygon being generally parallel to the supporting surface 509 and the plane of the table top 507. Analogous planes defined by the remaining members 503, 505 and polygon sides 526B, 526C, respectively, intersect the plane of the polygon at the same support angle B5.

Each member 501, 503, 505 also has first and second lateral surfaces 525, 527, as shown in FIGS. 27, 28 and 29, which together with the upper and lower ends 517, 519, form a trapezoid in frontal view. The lateral surfaces 525, 527 are at cutting angles (not visible) to the plane of the lower end 519 and are fitered at a reference angle E1 with respect to the longitudinal midline 524ML of the lower end 519. For this example of the second preferred embodiment of the invention, both cutting angles equal 90 degrees, and the reference angle equals 30 degrees. Each lateral surface 525, 527 has a wide, shallow, parallelogram-shaped channel 529, 531 which extends from the lower end 519 to near the upper end 517 and which is centered between the inside and outside surfaces 521, 523. A semicircular groove 533, 535 extends the length of each channel bottom 532, 534 along the center of the channel 529, 538. The lateral surfaces 525, 527 are mitered and the channels 529, 531 and grooves 533, 535 are formed during prefabrication.

The metal connectors 511, 513, 515 each comprise an immovable hinge assembly which, as shown in FIGS. 30-33, and 37, includes first and second opposing leaves 537, 539, a hinge pin 540, and a spherical foot 542. The first and second opposing leaves 537, 539 have the same parallelogram shape as the channels 529, 531 in the first and second lateral surfaces 525, 527, respectively, and the axes 537AX, 539AX of both leaves 537, 539 lie at equal axial angles F1 to the lower edges of the leaves 537, 539, which axial angles F1 are acute angles for all second preferred embodiments of the invention. Each leaf 537, 539 has a front face 541, 543, a back face 545, 547, and a set of knuckles 549, 551 spaced regularly along the axis 537AX, 539AX of the leaf 537, 539 and extending away from the front face 541, 543. It also has a flat plate portion 553, 555 on both sides of the knuckles 549, 551 and a set of holes 557, 559 which are spaced regularly along the plate portion 553, 555 and are countersunk on the front face 541, 543. The thicknesses of the flat plate portions 553, 555 equals the depths of the channels 529, 531 in the first and second lateral surfaces 525, 527, respectively.

Figure 34:
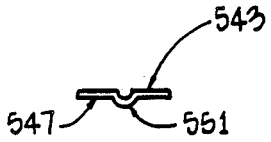
FIG. 34 is an end view of the second opposing leaf of FIG. 32 looking from a section line as indicated by line 34—34 in FIG. 32.
Figure 35:
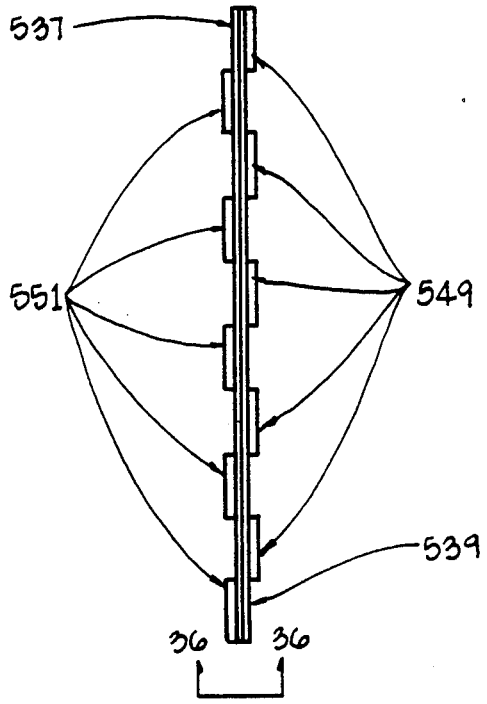
FIG. 35 is a side view of the first and second opposing leaves of FIGS. 30 and 32 in front face-to-front face contact.
Figure 36:
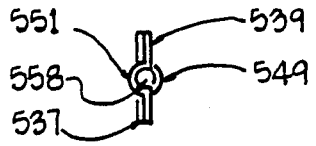
FIG. 36 is an end view of the first and second opposing leaves of FIG. 35 looking from a section line as indicated by line 36—36 in FIG. 35.
Figure 37:
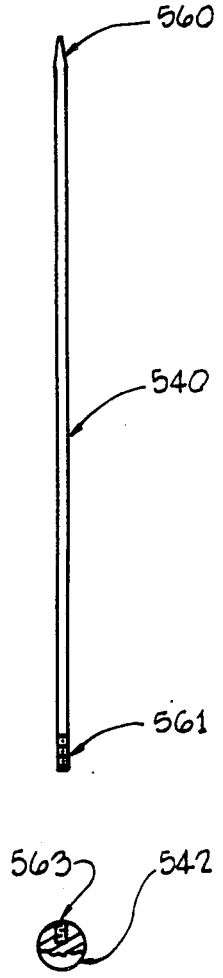
FIG. 37 is an elevation view of a hinge and spherical foot, the spherical foot being vertically cut away, of a connector of the table base of FIG. 25.

The knuckles 549, 551 have a semicircular cross section, as depicted in FIG. 34, and are arranged along the opposing leaves 537, 539 so that when the leaves 537, 539 are disposed in front face-to-front face contact, the knuckles 549, 551 on each leaf 537, 539 fit into the spaces between the knuckles 549, 551 on the other leaf 537, 539, as shown in FIG. 35, and cooperate to form the circular "hole" 558 along the center of the disposed leaves 537, 539, as shown in FIG. 36. The length and width of the knuckles 549, 551 and the spaces between them are designed to ensure a minimum tolerance between interweaving knuckles 549, 551 and, consequently, a tight fit between disposed leaves 537, 539.

The hinge pin 540 has a circular cross section, and its outer radius closely corresponds to the inner radius of the "hole" 558 in the disposed leaves 537, 539 of FIG. 36 so the hinge pin 540 can be inserted in the "hole" 558 with a minimum tolerance between the pin 540 and the knuckles 549, 551. The hinge pin 540 also has a tapered end 560 and a threaded end 561. The spherical foot 542 has a radial hole 563 which is tapped to correspond to this threaded end 561 and is deep enough to provide a secure anchor for the hinge pin 540, which is threaded into the foot 542 during fabrication. The length of a hinge pin 540 equals the length of a leaf 537, 539 plus the depth of the hole 563 in the foot 542.

During prefabrication, the first and second opposing leaves 537, 539 of each connector 511, 513, 515 are disposed within the channels 529, 531 in the first and second lateral surfaces 525, 527, respectively, of each member 501, 503, 505 with the back sides 545, 547 of the leaves 537, 539 contacting the channel bottoms 532, 534. The leaves 537, 539 are then attached to their respective channel bottoms 532, 534 by flat head screws. Since the holes 557, 559 in the plate portions 553, 555 of the leyes 537, 539 are countersunk and since the thickness of the plate portion 553, 555 of each leaf 537, 539 equals the depth of the respective channel 529, 531, the face of each lateral surface 525, 527 with its respective leaf 537, 539 attached is flat, except for the protruding set of knuckles 549, 551.

The prefabricated components for the second embodiment of the invention include only the rigid members 501, 503, 505, with leaves 537, 539 attached, and the hinge pin 540 for each of the connectors 511, 513, 515, with the spherical foot 542 attached. Again, such few components facilitate packing, shipping, and assembly.

Figure 38:
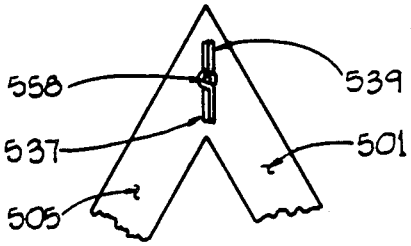
FIG. 38 is an end view of the joint between adjacent rigid members looking along the axis of the opposing leaves.

The members 501, 503, 505 are assembled in the inverted truncated pyramid of FIGS. 25 and 26 by first abutting at a first interface 567 the first lateral surface 525 of a first member 501, with its first leaf 537 attached, against the second lateral surface 527 of a first adjacent member 505, with its second leaf 539 attached. The knuckles 549 on the first leaf 537 fit through the spaces between the knuckles 551 on the second leaf 539 and into the groove 535 in the second lateral surface. Similarly, the knuckles 551 on the second leaf 539 fit through the spaces between the knuckles 549 on the first leaf 537 and into the groove 533 in the first lateral surface. The front face-to-front face contact of the first and second leaves 537, 539 creates the "hole" 558, as shown in FIG. 38, which runs the length of the leaves 537, 539. A hinge pin 540 is then fully inserted into this "hole" 558, the foot 542 abutting the lower edges of the leaves 537, 539. Since the lower edges of the leaves 537, 539 are parallel to the lower ends 519 of the adjacent members 501, 505 and since the hinge pin 540 lies along the axes 537AX, 539AX of the opposing leaves 537, 539, the hinge pin 540 lies at an acute angle, i.e., at the axial angle F1, to the plane of the previously defined polgon.

This procedure is then twice repeated by abutting at a second interface 569 the second and first lateral surfaces 527, 525 of the first member 501 and a second adjacent member 503, respectively, and by abutting at a third interface 571 the remaining first and second lateral surfaces 525, 527 of the first and second adjacent members 505, 503 respectively. Thereafter, a hinge pin is been inserted in each of the two resulting "holes" 558. Each hinge pin 540 is then spaced from an adjacent hinge pin 540 by a distance equal to the length of the lower end 519 of a member 501, 503, 505 and is rotated relative to the adjacent hinge pin 540 about a line perpendicular to the plane of the polygon and passing through the intersection of the axis of the hinge pin 540 and the midline 524ML of the lower end 519 of a member 501, 503, 505, the angle of rotation equalling 360 degrees divided by the number of rigid members, i.e., 120 degrees. After the hinge pins 540 have been inserted in the "holes" 558, the assembled configuration of members 501, 502, 505 is placed on its feet 542 on the supporting surface 509, elasomeric pads 565 are disposed along the upper ends 517 of the members 501, 503, 505, and the table top 507 is placed on the pads 565, as shown in FIGS. 25 and 26.

Figure 40:
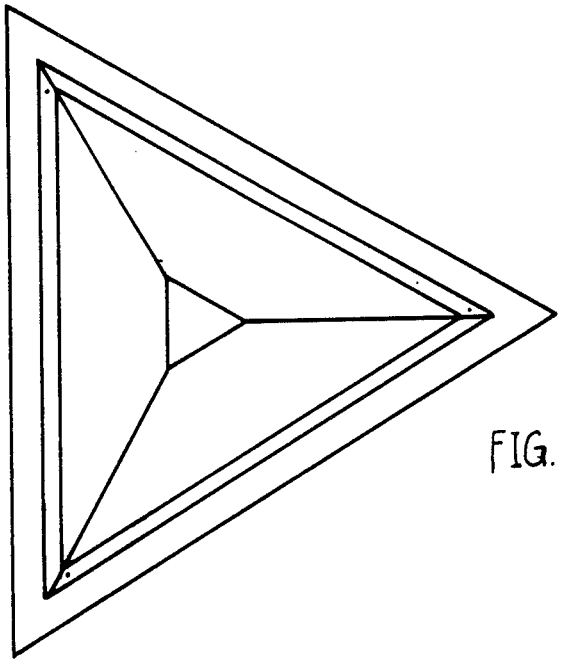
FIG. 40 is a top plan view of the table base of FIG. 39.
Figure 39:
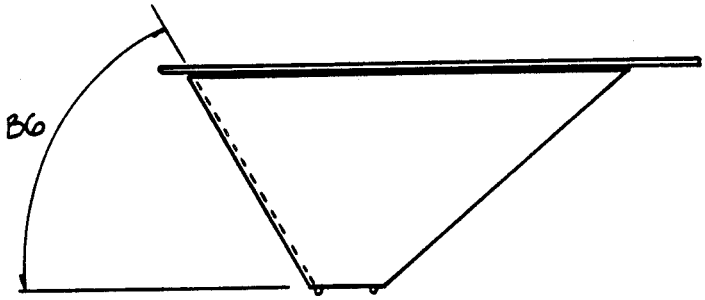
FIG. 39 is an elevation view of another example of the second preferred embodiment of the invention illustrating a table base with a support angle smaller than that of the table base of FIG. 26.
Figure 42:
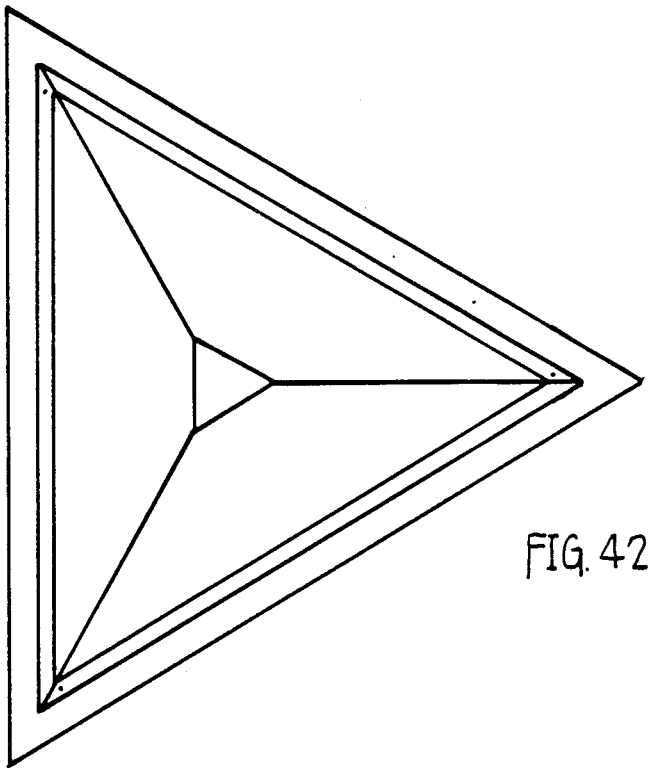
FIG. 42 is a top plan view of the table base of FIG. 41.
Figure 41:
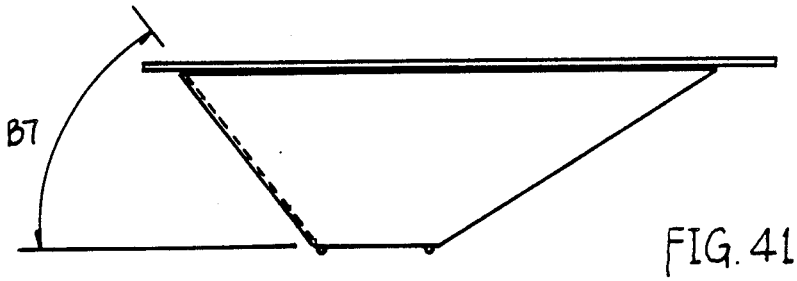
FIG. 41 is an elevation view of another example of the second preferred embodiment of the invention illustrating a table base with a support angle smaller than that of the table base of FIG. 39.
Figure 44:
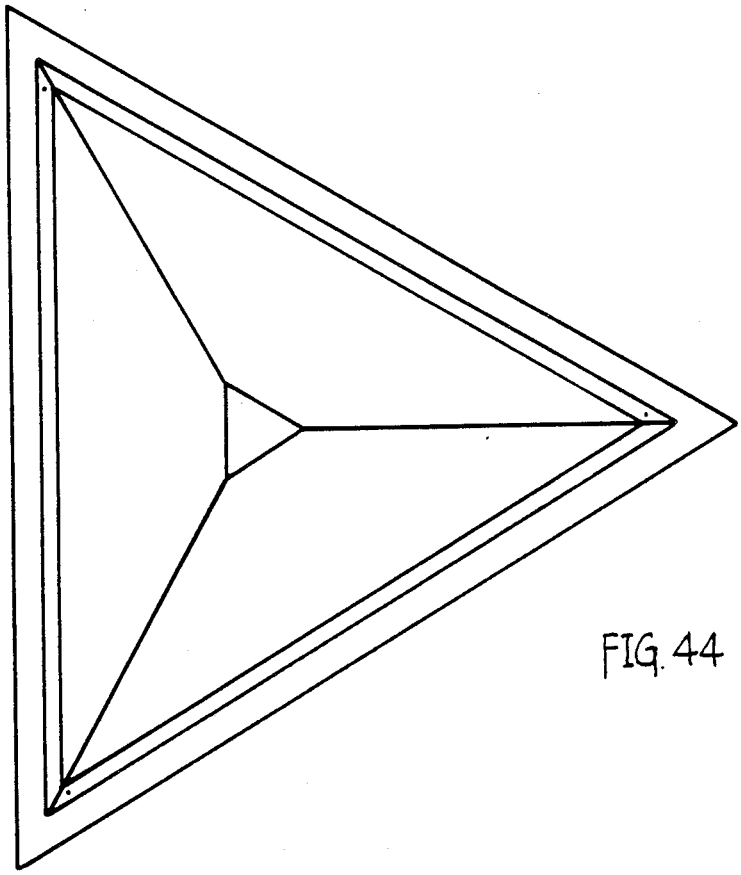
FIG. 44 is a top plan view of the table base of FIG. 43.
Figure 43:
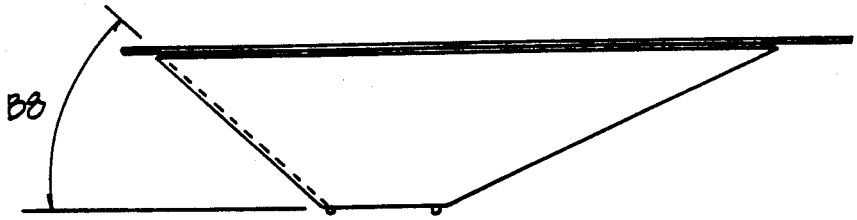
FIG. 43 is an elevation view of another example of the second preferred embodiment of the invention illustrating a table base with a support angle smaller than that of the table base of FIG. 41.
Figure 47:
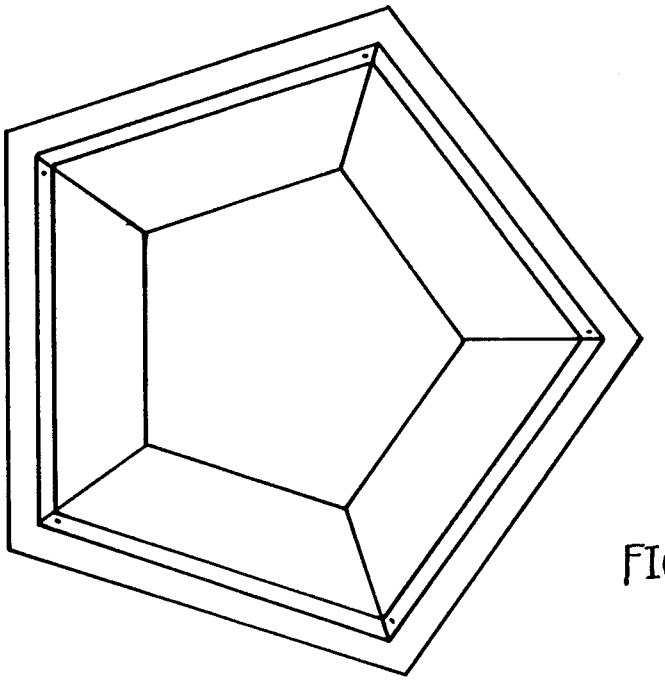
FIG. 47 is a top plan view of another example of the second preferred embodiment of the invention illustrating a table base which includes five identical rigid members and five identical connectors.
Figure 48:
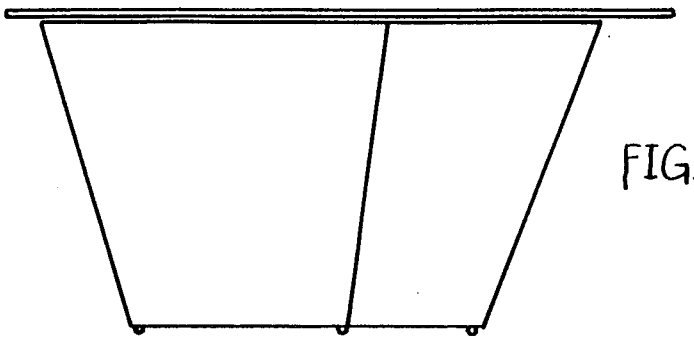
FIG. 48 is an elevation view of the table base of FIG. 47.
Figure 45:
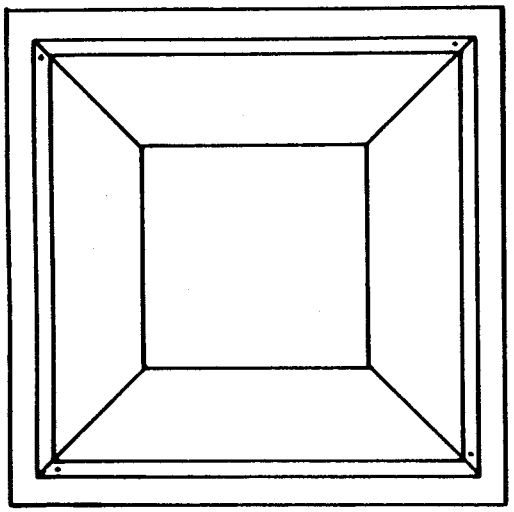
FIG. 45 is a top plan view of another example of the second preferred embodiment of the invention illustrating a table base which includes four identical rigid members and four identical connectors.
Figure 46:
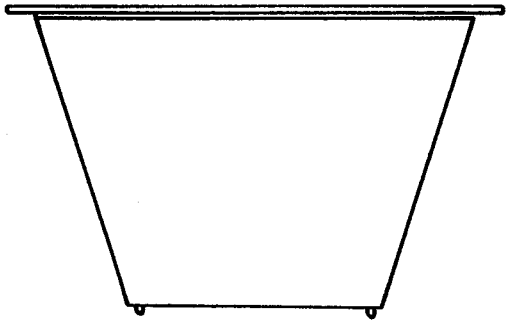
FIG. 46 is an elevation view of the table base of FIG. 45.
Figure 51:
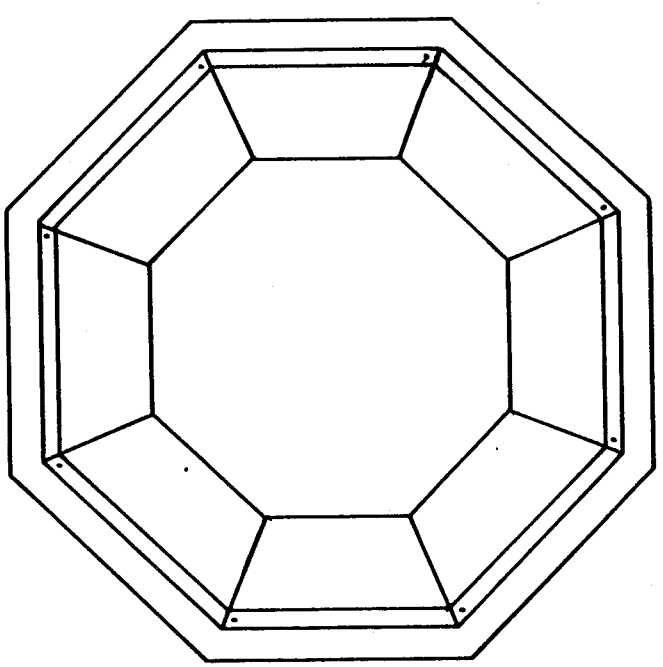
FIG. 51 is a top plan view of another example of the second preferred embodiment of the invention illustrating a table base which includes eight identical rigid members and eight identical connectors.
Figure 52:
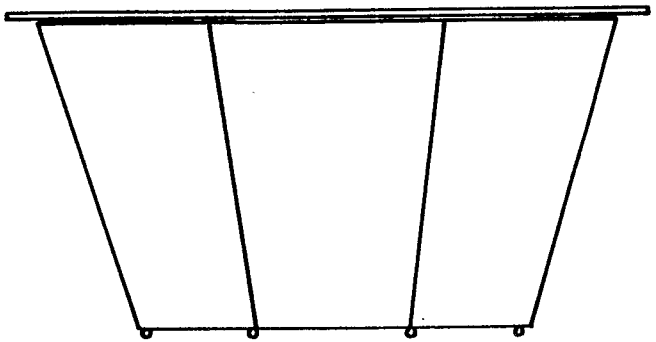
FIG. 52 is an elevation view of the table base of FIG. 51.
Figure 49:
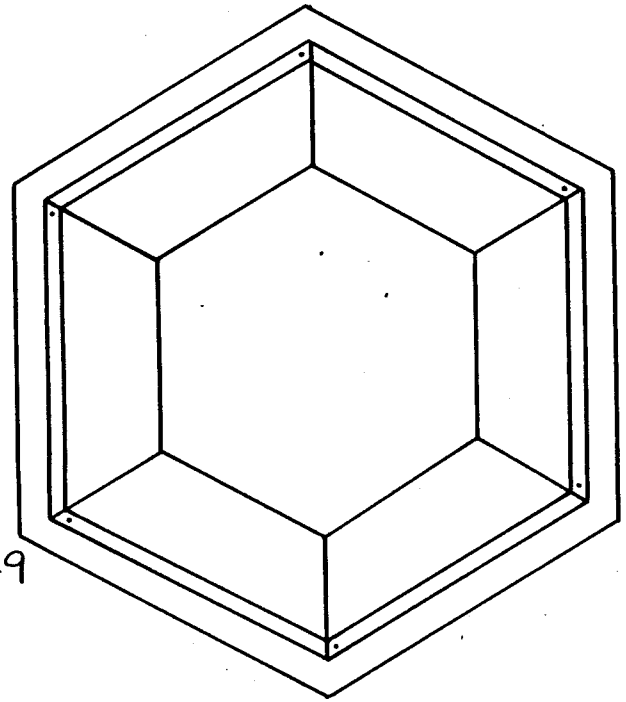
FIG. 49 is a top plan view of another example of the second prefered embodiment of the invention illustrating a table base which includes six identical rigid members and six identical connectors.
Figure 50:
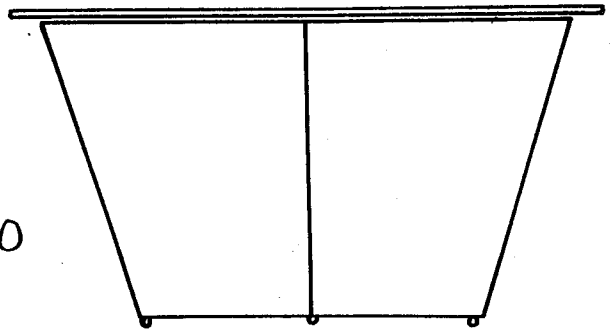
FIG. 50 is an elevation view of the table base of FIG. 49.

FIG. 39 presents an example of the second preferred embodiment of the invention which is very similar to the table base of FIGS. 25 and 26, except that its support angle B6 is smaller than that of the table base shown in FIGS. 25 and 26. In fact, FIG. 39, FIG. 41 and FIG. 43 present a series of similar table bases, each differing from the one before it only by a smaller support angle B5, B6, B7, B8. The principal consequences of this decrease in the support angle are a change in the cross section of each member and a decrease in the axial angle for each connector. Thus, in entire family of tables, from a dining table (FIGS. 25 and 26) through a cocktail table (FIGS. 39 and 40) and an end table (FIGS. 41 and 42) down to a coffee table (FIGS. 43 and 44), can be manufactured by making only slight changes in the specifications for each member and connector. While the height of these tables varied because the support angle varied, these height could also have been effected by merely varying the height of the members.

Although all of the members of each of the examples depicted in FIGS. 25, 26 and 39–44 define equal support angles, these angles are independent of one another, and each may be specified separately according to a desired appearance of the table base. Thus, for yet another example (not shown) of the second preferred embodiment of the invention, each of the members defines a different support angle. However, since the support angles are not equal, the members and the connectors are not identical. The cross section and the cutting angle for each lateral surface of each member and the shape of each connector depend on the support angles specified.

FIGS. 45–52 present still further examples of the second preferred embodiment of the invention. Each example comprises a given number of rigid members which support a glass table top above a supporting surface and an equal number of connectors which fixedly maintain the members as an inverted truncated pyramid. Thus, FIGS. 45 and 46, 47 and 48, 49 and 50, and 51 and 52 respectively show table bases having four members and four connectors, five members and five connectors, six members and six connectors, and eight members and eight connectors. Other examples having a different number of members could have been shown, but, for purposes of illustration, those presented are sufficient.

The only principal difference between the table bases shown in FIGS. 45–52 and the table base discussed on connection with FIGS. 25 and 26 is the number of members and connectors comprising the table base. For any one of these table bases, all of the members are identical, each member comprising a standard wood frame and fiberglass shell with wiper and lower ends, inside and outside surfaces, and first and second lateral surfaces similar to those previously described nd shown in FIGS. 27, 28, and 29. Further, all of the connectors are identical, each connector comprising an immovable hinge assembly similar to that described above and shown in FIGS. 30–33, and 37. And finally, the method of assembling these table bases is identical, each member being connected to a first adjacent member at a first interface by one connector and to a second adjacent member at a second interface by another connector, again, as previously described and shown in FIGS. 25, 26, and 38.

The differing number of members does, however, give rise to certain secondary differences. The reference angle and the axial angle depend on the number of members comprising the table base. Thus, the reference and axial angles for the four-, five-, six-, and eight-member table bases are all different from that of the three-member table base and each different from one another. However, for any example of the second preferred embodiment of the invention which has the number of members and the support angles specified, the intersect distance and the projection angle can be determined empirically by standard drafting techniques, i.e., by drafting the desired support structure and determining the angles from the resulting drawing.

Figure 53:
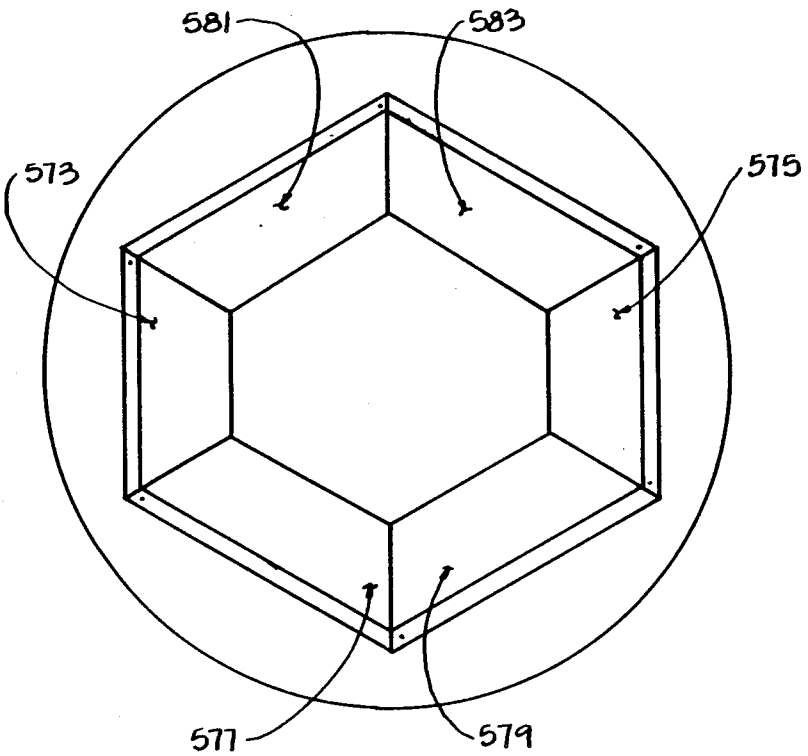
FIG. 53 is a top plan view of another example of the second preferred embodiment of the invention illustrating a table base which includes six rigid members, not all identical, and six identical connectors.

Although all of the members of each of the examples of the second preferred embodiment depicted in FIGS. 45–52 are identical, the widths of opposite members in a configuration comprising an even number of members can differ from the widths of the remaining components of the invention. However, the widths of the opposite members must be equal. Thus, in FIG. 53, one pair of opposite members 573, 575 is less wide than the remaining members 577, 579, 581, 583. However, in all other respects this example is identical to the example depicted FIGS. 46 and 47.

Figure 54:
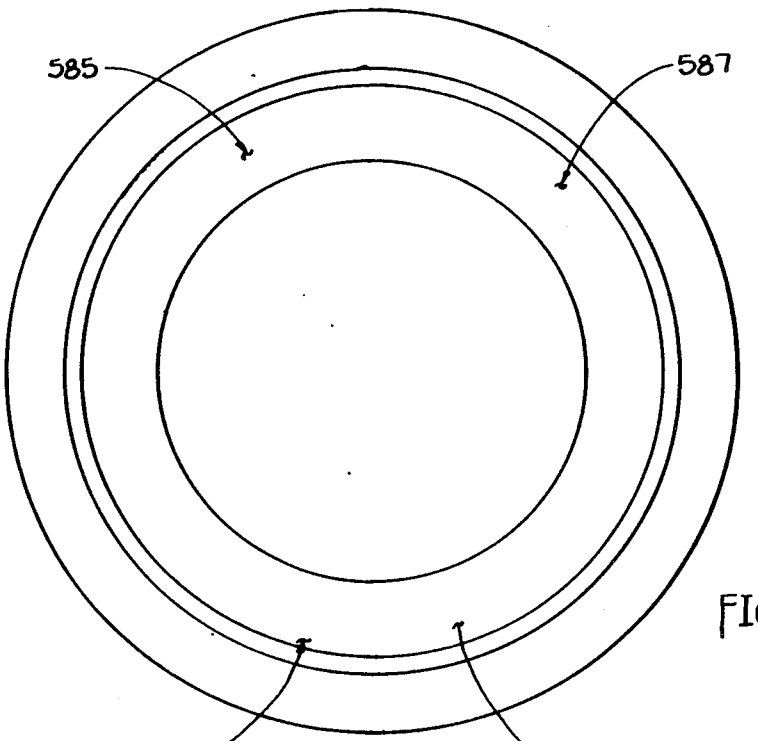
FIG. 54 is a top plan view of another example of the second preferred embodiment of the invention illustrating a table base which includes four identical arcuate members and four identical connectors.
Figure 55:
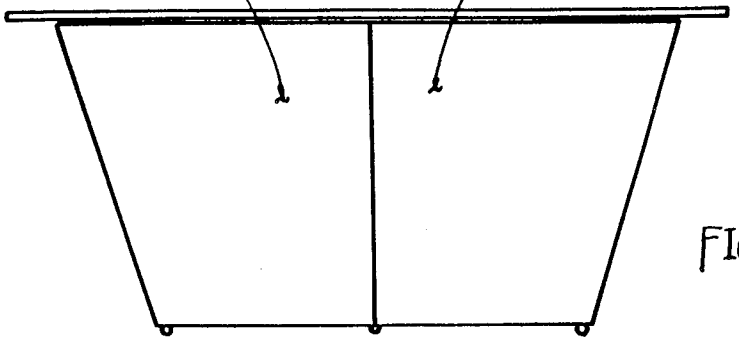
FIG. 55 is an elevation view of the table base of FIG. 54.

FIGS. 54 and 55 present yet another example of the second preferred embodiment of the invention. The polygon defined by midlines 524ML of the lower ends of the members 585, 587, 589, 591 comprises infinitely many infinitesimally small sides, i.e., a circle. In all other respects, this example is analogous to the previous examples of the second preferred embodiment of the invention.

It will be understood that further modifications and variations may be effected without departing from the spirit and scope of the novel concepts of this invention.

I claim:

1. A support structure for supporting a table top or the like above a supporting surface, the support structure comprising:

(a) a plurality of rigid members, each member
  (i) having an upper end proximate to the table top and a lower end proximate to the supporting surface and
  (ii) supporting a portion of the table top above the supporting surface, and (b) a plurality of connecting means for connecting the members, each connecting means including an elongate metal piece and means providing metal surface portions engaged with said elongate metal piece along the length thereof with said piece being arranged to act in one capacity as a pin which cooperates with said metal surface portions to connect adjacent members and to prevent relative movement in any direction angularly related to the longitudinal axis of said piece, (c) wherein each member contacts and is fixedly connected to
  (i) a first adjacent member at a first interface by a first one of said connecting means and (ii) a second adjacent member at a second interface by a second one of said connecting means, said second interface being spaced from said first interface, each member thereby also supporting two adjacent members, and (d) wherein said plurality of connecting means fixedly maintains said plurality of members in a rigid configuration in which (i) the lower ends of the members define a polygon;

(ii) the plane defined by one side of said polygon and a central axis of a member defining said side intersects the plane of said polygon at a support angle, said support angle being an acute angle, and (iii) the longitudinal axis of each elongate metal piece intersects the plane of said polygon at an acute angle, each elongate metal piece cooperating with metal surface portions engaged therewith to resist relative pivotal movement about axes which intersect the longitudinal axis thereof and to also resist relative movement in response to forces in various directions angularly related to said longitudinal axis including directions which are either perpendicular or parallel to the plane of said polygon.

2. The support structure of claim 1 wherein the longitudinal axes of said elongated metal pieces of said first and second connecting means are spaced and rotated a predetermined distance and angle, respectively, with respect to each other.

3. The support structure defined in claim 1 wherein said defined plane and said longitudinal axis of each elongate metal piece intersect the plane of the table top at an acute angle.

4. The support structure of claim 1:

(a) wherein said support angle for each said member and the number of said members are predetermined according to a desired appearance and (b) wherein the number of said connecting means equals the predetermined number of said members.

5. The support structure of claim 1, 2, 3, or 4

(a) wherein each member is elongate, and (b) wherein the plurality of connecting means fixedly maintains the plurality of members in a tepee-like configuration.

6. The support structure of claim 5 wherein each member has a circular cross section.

7. The support structure of claim 5

(a) wherein the location of said first and second interfaces on each said member varies according to a predetermined support angle for each said member and a predetermined number of said members, (b) wherein each member has a hole located therein at said first and second interfaces, (i) the axis of the hole at the first interface being aligned with the axis of a corresponding hole in the first adjacent member and (ii) the axis of the hole at the second interface being aligned with the axis of a corresponding hole in the second adjacent member, and (c) wherein the first one of said connecting means includes an elongated metal piece disposed within the aligned holes of said member and said first adjacent member, and (d) wherein the second one of said connecting means includes an elongated metal piece disposed within the aligned holes of said member and said second adjacent member.

8. The support structure of claim 5 including means for leveling the support structure.

9. The support structure of claim 1, 2, 3, or 4

(a) wherein each member has, for a front elevation view, a trapezoid, and (b) wherein the plurality of connecting means fixedly maintain the plurality of members as an inverted truncated pyramid.

10. The support structure of claim 9

(a) wherein each member has a first and a second lateral surface and (b) wherein the plurality of connecting means fixedly maintains the plurality of members as an inverted truncated pyramid with the first lateral surface of each member contacting and fixedly connected to the second lateral surface of a first adjacent member and the second lateral surface of said member contacting and fixedly connected to the first lateral surface of a second adjacent member.

11. The support structure of claim 10 wherein the connecting means comprises an immovable rigid hinge means comprising (a) a pair of leaves, (i) each leaf having a set of knuckles, the two sets of knuckles of the pair of leaves interweaving to form a hole running the length of the leaves when one leaf of the pair is superposed on the other leaf of the pair, and (ii) one leaf of the pair attached to the first lateral surface of one member and the other leaf of the pair attached to the second lateral surface of an adjacent member, the leaves being disposed on the lateral surfaces to allow superposition of the leaves when the lateral ends contact each other, and (b) an elongate metal piece disposed within the hole formed by the interweaving sets of knuckles.

* * * * *